United States Patent [19]

Beretta

[11] 4,288,939

[45] Sep. 15, 1981

[54] ADJUSTABLE LEGS SUPPORT FOR AUTOMATIC WEAPONS

[75] Inventor: Pier C. Beretta, Gardone V.T., Italy

[73] Assignee: Fabbrica d'Armi Pietro Beretta S.p.A., Gardone V.T., Italy

[21] Appl. No.: 25,020

[22] Filed: Mar. 29, 1979

[30] Foreign Application Priority Data

Apr. 4, 1978 [IT] Italy ..... 6966/78[U]

[51] Int. Cl.[3] ..... F41C 29/00

[52] U.S. Cl. ..... 42/94

[58] Field of Search ..... 42/94; 89/37 B, 37 BA, 89/40 E; 248/168, 434, 435

[56] References Cited

U.S. PATENT DOCUMENTS

| | | | |
|---|---|---|---|
| 1,524,973 | 2/1925 | Hazelton | 42/94 |
| 1,806,454 | 5/1931 | Goudeau | 248/168 |
| 2,420,267 | 5/1947 | Sefried | 42/94 |

*Primary Examiner*—Stephen C. Bentley

[57] ABSTRACT

A support for an automatic weapon includes a sleeve axially coupled to a tubular part of the weapon and including a pair of diametrically opposed lateral wings as well as two folding rods pivotal on the wings. The rods are angularly displaceable from a parallel position to a perpendicular position.

9 Claims, 6 Drawing Figures

1
17
16
1'
8
4
18
19
3

ADJUSTABLE LEGS SUPPORT FOR AUTOMATIC WEAPONS

The present invention relates generally to automatic weapons and more particularly for portable weapons, such as for example, machine pistols, automatic rifles, etc.

In the field of portable automatic weaponary, supports for the weapon are already known consisting substantially of means such as legs for resting the automatic weapon on the ground during its use. These support means are of the type, for example, having telescopically adjusting legs. This arrangement, however, does not always permit an easy and rapid application of the support to the various conditions and situations of use.

It is, therefore, an object of the present invention to provide a support for automatic weapons having various possibilities of application so as to adjust, on one hand, the elevation (height) of the support and, on the other hand, the permit the most comfortable and convenient application of the support to the conditions of the terrain of which the weapon is resting.

It is another object of the present invention to provide a support having a pair of legs comprising rods foldable onto themselves for angular displacement and, als, movable toward the barrel of the weapon when the support is not in use.

These and other objects are achieved with the support for automatic weapons of the present invention, a practical example of which will be herebelow described with reference to the accompanying drawings, in which.

Figure 3:
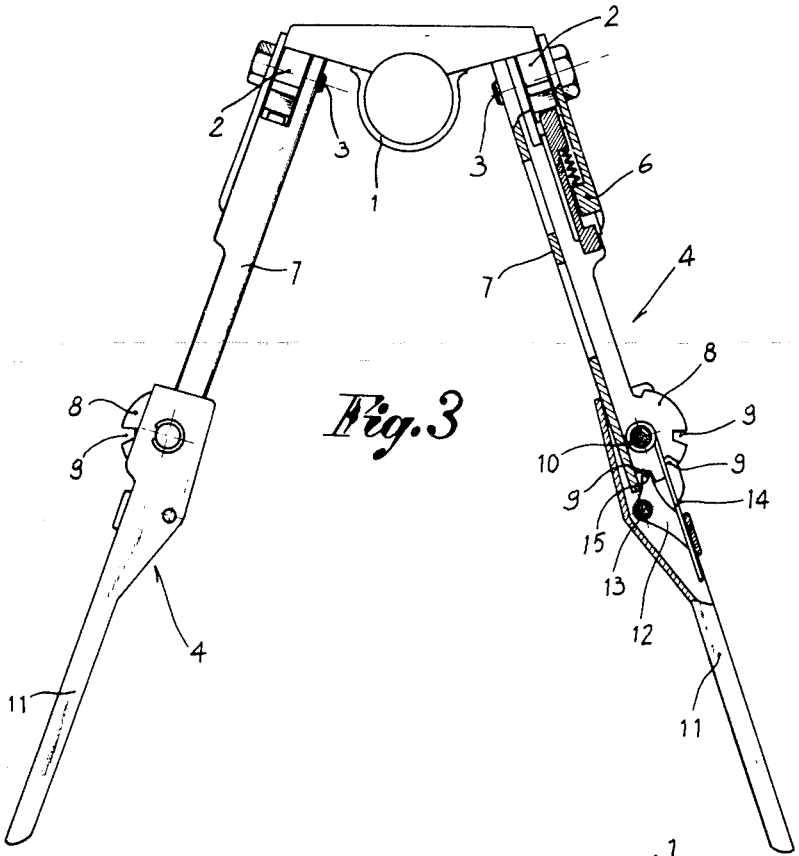
FIG. 3 is a partial sectional elevational view of the application of the support means of this invention.

The support of the present invention comprises a sleeve 1 on which are provided, so as to be diametrically opposed to each other, two wings 2, one on each side of the sleeve 1. On each wing 2 there is pivoted at 3 a foldable rod 4 that is angularly displaceable from a parallel position to a perpendicular position with respect to the axis of the sleeve 1, and viceversa, the two positions are limited by shoulder means provided on the lateral wings 2 and by spring-loaded arresting means 6 mounted on each of the foldable rods 4 and engaging the wings 2.

More particularly, each foldable rod 4 is comprised of a first, rod-like member 7 with one extremity thereof attached at 3 to the respective wing 2 of the sleeve 1, and with the opposite extremity having two semicircular portions 8 on the periphery of which there are provided several radial notches 9 spaced angularly apart from one another. To the semicircular portions 8 of the first member 7 there is pivotably attached, by means of a transverse pin 10, a second, rod-like member 11, to which is pivotably attached at 13 an arresting lever 12 that is actuated by a spring 14 and having at least one terminal projection 15 facing toward and engaging one or another of the radial notches 9 of the semicircular portions 8 of the first rod-like member 7.

The second rod-like member 11 of each foldable rod 4 of the support of this invention is angularly displaceable from a position of alignment with the first rod-like member 7 to a position of coupling.

The application of the above-described support to a weapon, such as a sub-machine gun 16 illustrated in the drawings, is obtained by coupling the sleeve 1 with a tubular element 17 of the recovery spring of the weapon itself. Such coupling is obtained, for example, by means of a bayonet-type insertion in a bayonet with annular construction (see FIG. 4) including a semicircular rib 18 provided at one extremity of the sleeve 1, rotationally engaged by a semicircular throat 19 suitably provided on the tubular element 17. The coupling prevents any axial displacement of the support on the weapon, while favoring, instead, some orienting of the support around the tubular element 17, always within the limits permitted by the resting action of the support against the barrel 1' of the weapon, which barrel 1' extends parallel to the tubular lement 17.

As a result, there is achieved another advantageous adaptability of the support in addition to that offered by the folding of the rods.

Figures 2, 4, 5, 6:
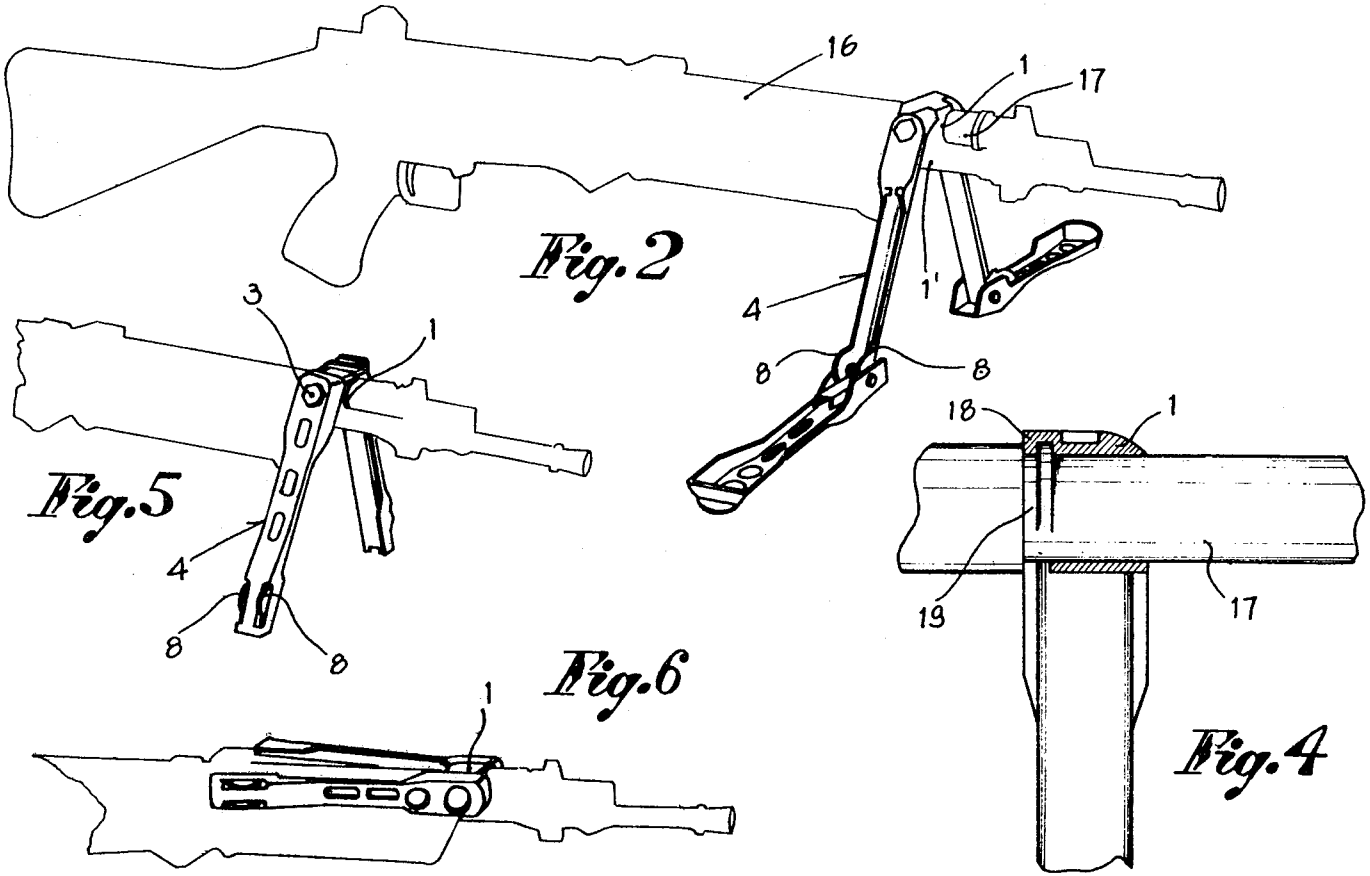
FIG. 2 is a perspective view similar to that of FIG. 1, but with the support means of this invention in a different use condition.
FIG. 4 is a fragmentary sectional elevational view of the application of the support means of this invention.
FIGS. 5 and 6 show in fragmentary perspective and side elevational views, respectively, two successive phases of folding of the support means of this invention and of movement of its legs toward the barrel of the weapon.

In fact, the second, rod-like member 11 of each folding rod 4 of the support comprising the present invention is angularly displaceable around the transverse pin 10 from a position of alignment with the corresponding first, rod-member 7 to a position of approachment face to face as shown in FIG. 5 with a plurality of intermediate positions determined by the arresting lever 12 in cooperation with the radial notches 9. To these intermediate positions correspond an equal number of different inclinations of the second, rod-like member 11 and, consequently, an equal number of varied applications of the support to the features of the resting plane or supporting surface. The adaptation of each rod 4 is, obviously, independent from the other rod 4 and is obtained each time simply by acting on the arresting lever 12.

Figure 1:
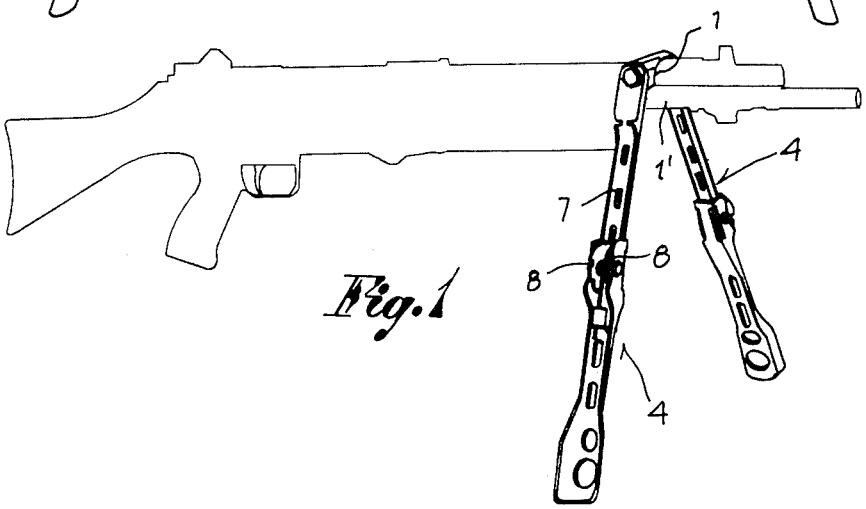
FIG. 1 is a perspective view of a sub-machine gun provided with support means comprising the present invention wherein the legs are at their maximum height.

It is, thus, possible to achieve an easy and comfortable use of the support invarious conditions, a few of which are shown in FIGS. 1, 2 and 5 of the accompanying drawings. It is also possible to have a complete folding action of the rods 4 up against the weapon itself, when the support is not in use. This is effected through angular displacement of the folded rods 4 around the respective pivots 3 as shown in FIG. 6 of the drawings.

I claim:

1. An adjustable leg support for automatic weapons, said support comprising a sleeve defining coupling means that is adapted to engage a tubular part of the weapon, two lateral wings integral with said sleeve, said wings being diametrically opposed to each other and positioned on opposite sides of said coupling means, two elongaged folding rods each having one end pivotally mounted on said wings and angularly displaceable from a parallel position to a perpendicular position with respect to the longitudinal axis of said sleeve, said parallel and perpendicular positions being limited by shoulders provided on said wings, and spring-loaded arresting means mounted on said rods and arranged to engage said wings, each of said folding rods comprising first and second rodlike elements pivotally coupled to each other at their contiguous extremities, the opposite extremity of each said first rod-like element being mounted on said respective wing, each said second rod-like element being adapted to move angularly from an alignment position to a non-alignment position relative to said respective first rod-like element, said opposite extremity of each said first rod-like element being pivoted on a lateral ear of said sleeve and wherein its contiguous extremity includes two arcuate portions that are provided with a plurality of angularly spaced apart notches on the periphery thereof, each said second rod-like element being coupled to said respective arcuate portions on said first rod-like elements by means of a transverse pin, said second rod-like elements each including a spring-loaded, pivotally mounted lever having at least one terminal projection facing toward and engaging one of said notches of said arcuate protions on said first rod-like elements so as to define the angular relationship of said second rod-like elements with respect to said respective first rod-like elements.

2. The support as defined in claim 1, further including means for providing releasable engagement of said sleeve and the weapon.

3. The support as defined in claim 2, wherein said releasing engagement means is defined by an arcuate rib on said sleeve, said rib being adapted to be received in an arcuate throat on said weapon.

4. The support as defined in claim 1, wherein the biasing force of said spring-loaded arresting means is provided by a compression spring.

5. The support as defined in claim 1, wherein the biasing force of said spring-loaded, pivotally mounted lever is provided by a torsion spring.

6. An adjustable leg support for automatic weapons, said support comprising a sleeve defining coupling means that is adapted to engage a tubular part of the weapon, two lateral wings integral with said sleeve, said wings being diametrically opposed to each other and positioned on opposite sides of said coupling means, two elongated folding rods each having one end pivotally mounted on said wings and angularly displaceable from a parallel position to a perpendicular position with respect to the longitudinal axis of said sleeve, said parallel and perpendicular positions being limited by shoulders provided on said wings, and spring-loaded arresting means mounted on said rods and arranged to engage said wings, each of said folding rods comprising first and second rod-like elements pivotally coupled to each other at their contiguous extremities, the opposite extremity of each said first rod-like element being mounted on said respective wing, each said second rod-like element being adapted to move angularly from an alignment position to a non-alignment position relative to said respective first rod-like element, there being further included releasable engagement means defined by an arcuate rib on said sleeve, said rib being adapted to be received in an arcuate throat on said weapon.

7. The support as defined in claim 6, wherein said opposite extremity of each said first rod-like element is pivoted on a lateral ear of said sleeve and wherein its contiguous extremity includes two arcuate portions that are provided with a plurality of angularly spaced apart notches on the periphery thereof, each said second rod-like element being coupled to said respective arcuate portions on said first rod-like elements by means of a transverse pin, and said second rod-like elements each including a spring-loaded, pivotally mounted lever having at least one terminal projection facing toward and engaging one of said notches of said arcuate portions on said first rod-like elements so as to define the angular relationship of said second rod-like elements with respect to said respective first rod-like elements.

8. The support as defined in claim 6, wherein the biasing force of said spring-loaded arresting means is provided by a compression spring.

9. The support as defined in claim 7, wherein the biasing force of said spring-loaded, pivotally mounted lever is provided by a torsion spring.

* * * * *